US007062205B2

(12) United States Patent
Nagashiro

(10) Patent No.: US 7,062,205 B2
(45) Date of Patent: Jun. 13, 2006

(54) STRUCTURE FOR LOCKING A SHUTTER MEMBER IN A TONER SUPPLYING CONTAINER

(75) Inventor: Keiichi Nagashiro, Kanagawa (JP)

(73) Assignee: Kyocera Mita Corporation, Osaka (JP)

( * ) Notice: Subject to any disclaimer, the term of this patent is extended or adjusted under 35 U.S.C. 154(b) by 177 days.

(21) Appl. No.: 10/739,199

(22) Filed: Dec. 19, 2003

(65) Prior Publication Data

US 2004/0131391 A1 Jul. 8, 2004

(30) Foreign Application Priority Data

Dec. 24, 2002 (JP) ..... 2002-371425

(51) Int. Cl.
*G03G 15/08* (2006.01)

(52) U.S. Cl. ..... 399/258; 399/262; 222/DIG. 1

(58) Field of Classification Search ..... None
See application file for complete search history.

(56) References Cited

U.S. PATENT DOCUMENTS 5,300,991 A * 4/1994 Hiraike ..... 399/224
5,419,468 A * 5/1995 Taki ..... 222/554
5,848,338 A * 12/1998 Okada ..... 399/262
6,185,401 B1 * 2/2001 Kanamori et al. ..... 399/262
6,363,233 B1 3/2002 Nakajima
6,438,345 B1 * 8/2002 Ban et al. ..... 399/262
2002/0034404 A1 3/2002 Kojima et al.

FOREIGN PATENT DOCUMENTS

EP 843233 A2 * 5/1998
EP 1 184 741 3/2002
JP 5-249820 9/1993
JP 08297403 A * 11/1996
JP 09179363 A * 7/1997

* cited by examiner

*Primary Examiner*—Robert Beatty
(74) *Attorney, Agent, or Firm*—Smith, Gambrell & Russell, LLP

(57) ABSTRACT

A toner supplying container has a container body having a toner discharge opening, a shutter member, a lever member, and a locking member. The lever member at its closing position causes the elastic portion of the locking member to be elastically deformed to urge the locking member to the locking position. When the container body is mounted on the image-forming machine body, the locking member is displaced to a lock-releasing position, permitting the lever member to be turned from the closing position to the opening position.

5 Claims, 7 Drawing Sheets

STRUCTURE FOR LOCKING A SHUTTER MEMBER IN A TONER SUPPLYING CONTAINER

FIELD OF THE INVENTION

The present invention relates to a toner supplying container used for supplying a toner to a developing device provided for an electrostatic image-forming machine such as a printer, a copying machine or a facsimile.

DESCRIPTION OF THE RELATED ART

A toner is contained in a toner supplying container (toner supplying cartridge) used for supplying the toner to a developing device provided for the above-mentioned image-forming machine. After the toner supplying container containing the toner is mounted on the developing device or on the image-forming machine body, which is a mounting member, a toner carrier screw housed in the toner supplying container is rotated. Therefore, the toner held therein is discharged through a toner discharge opening and is supplied into the developing device.

It is not desired that the toner contained in the toner supplying container leaks to the outer side, before the toner supplying container of the form described above is mounted on the mounting member, or after the toner supplying container is removed from the mounting member, or when the toner supplying container is attached or detached. To prevent the leakage of the toner, there has already been proposed a toner supplying container provided with a locking means for locking the rotary drive portion of the toner-carrier screw before the toner supplying container is mounted on the image-forming machine body which is the mounting member or after it is removed therefrom (see Japanese Unexamined Patent Publication (Kokai) No. 5-249820).

The locking means comprises an engaging portion formed in a rotary portion of a screw drive gear for rotating the toner-carrier screw, a lock lever portion that is turnably formed on a protrusion that can engage with the engaging portion, and an urging spring portion for urging the lock lever portion to cause the protrusion of the lock lever portion to be engaged with the engaging portion. Before the toner supplying container is mounted on the body of the image-forming machine or after it is removed therefrom, the protrusion of the lock lever portion is brought into engagement with the engaging portion by the urging spring portion thereby to lock the toner-carrier screw. Further, in the case where the toner supplying container is mounted on the body of the image-forming machine, the locking is released after having disengaged the protrusion of the lock lever portion from the engaging portion against the urging spring portion by being pushed up by a lock lever push-up portion provided on the side of the body.

The above toner supplying container, however, requires an urging spring portion or, specifically, a metallic tensile coil spring, which is a separate member, for urging the lock lever portion, resulting in an increase in the number of parts and in an increase in the cost. Besides, since the tensile coil spring is made of a metal, sorting operation is necessary when the toner supplying container is to be disposed of.

SUMMARY OF THE INVENTION

It is an object of the present invention to provide a novel toner supplying container, which reliably prevents the leakage of the toner contained therein before it is mounted on a mounting member, or after it is removed therefrom, or at the time of being attached or detached, which is constituted by a decreased number of parts enabling the cost to be decreased, which as a whole can be constituted by using synthetic resin members only without at all using metallic parts, and which can be disposed of without requiring sorting operation.

According to the present invention, there is provided a toner supplying container comprising a container body having a toner discharge opening, a shutter member disposed in the container body so as to be turned between a closing position for closing the toner discharge opening and an opening position for opening the toner discharge opening, a lever member that is turnably supported by the container body and is drivably coupled to the shutter member so as to be turned between a closing position where the shutter member is brought to the closing position and an opening position where the shutter member is brought to the opening position, and a locking member supported by the container body so as to be turned between a locking position where the shutter member is locked to be inhibited from turning from the closing position to the opening position and a lock-releasing position where the shutter member is permitted to be turned from the closing position to the opening position and to be turned in the reverse direction, the locking member being provided with an elastic portion integrally.

It is desired that in a state where the lever member is brought to the closing position, the lever member urges the locking member toward the locking position by elastically deforming the elastic portion of the locking member and, when the container body is mounted on the mounting member, the locking member is displaced from the locking position to the lock-releasing position against the elastic force of the elastic portion to permit the lever member to be turned from the closing position to the opening position and, when the container body is removed from the mounting member in a state where the lever member has been turned from the opening position to the closing position, the locking member is returned back to the locking position due to the elastic force of the elastic portion.

It is desired that when the lever member is turned from the closing position to the opening position in a state where the container body has been mounted on the mounting member, the lever member exerts a decreased or no pushing force on the elastic portion of the locking member.

It is desired that:

- the container body has a bottom wall in which the toner discharge opening is formed and both end walls, and the shutter member comprises a substantially cylindrical shutter body that is turnably disposed in the container body so as to extend from one end wall along a partial region of the bottom wall and a shutter drive member that is coupled to the shutter body so as to be turned together with the shutter body and is supported by one end wall so as to be turned;
- the shutter body has a toner passage opening that matches with the toner discharge opening when the shutter member is brought to the opening position;
- the shutter drive member has an arcuately extending driven gear and a to-be-engaged protrusion extending in the axial direction, which are formed integrally;
- the lever member has a plate-like lever body having an arcuate peripheral surface, an operation lever extending outward from the lever body in the radial direction, and a cylindrical base portion that is formed on the central portion of the lever body and is supported by one end wall so as to be turned, a drive gear being formed on the arcuate peripheral surface of the lever body, and a pushing protrusion being formed on the cylindrical base portion so as to extend outward in the radial direction;

the locking member has a locking body that extends outward in the radial direction from a base end supported by one end wall so as to be turned and permits a position where the to-be-engaged protrusion of the shutter drive member exists in the axial direction, to be substantially extended in the direction of turning of the shutter drive member, and a belt-like elastic portion that extends outward in the radial direction from the base end on the outer side in the radial direction while interposing a partial region of the locking body relative to the axis of the shutter drive member, an engaging step being formed in the inner surface in the radial direction of the locking body so as to extend in the radial direction of the shutter drive member; and in a state where the lever member is brought to the closing position, the drive gear of the lever member is brought in mesh with a driven gear of the shutter drive member, and the pushing protrusion of the lever member pushes the elastic portion of the locking member so as to be elastically deformed, whereby the locking body of the locking member is urged to turn on the axis of the base end in a direction in which a region including at least the engaging step in the inner surface in the radial direction approaches the axis of the shutter drive member from the outer side in the radial direction, and the engaging step is engaged with an end surface of the to-be-engaged protrusion of the shutter drive member in the circumferential direction, i.e., with an end surface of the shutter drive member in a turning direction in which the shutter member is turned from the closing position toward the opening position.

It is desired that the front end surface of the locking body of the locking member is directed in the downward direction of the container body, and when the container body is mounted on the mounting member from the upper side and is brought into contact with the push-up protrusion disposed in the mounting member thereby causing the front end surface to be pushed up, the locking body of the locking member is caused to turn on the axis of the base end in a direction in which the inner surface thereof in the radial direction separates outward in the radial direction away from the shutter drive member against the elastic force of the elastic portion, and the engaging step is displaced from the locking position where it is engaged with the end surface of the to-be-engaged protrusion of the shutter drive member in the circumferential direction thereof, to the lock-releasing position where it is disengaged from said end surface.

It is desired that the container body, shutter member, lever member and locking member are made of a synthetic resin in a unitary structure.

DETAILED DESCRIPTION OF THE PREFERRED EMBODIMENTS

Preferred embodiments of a toner supplying container constituted according to the present invention will now be described in further detail with reference to the accompanying drawings.

Figure 1:
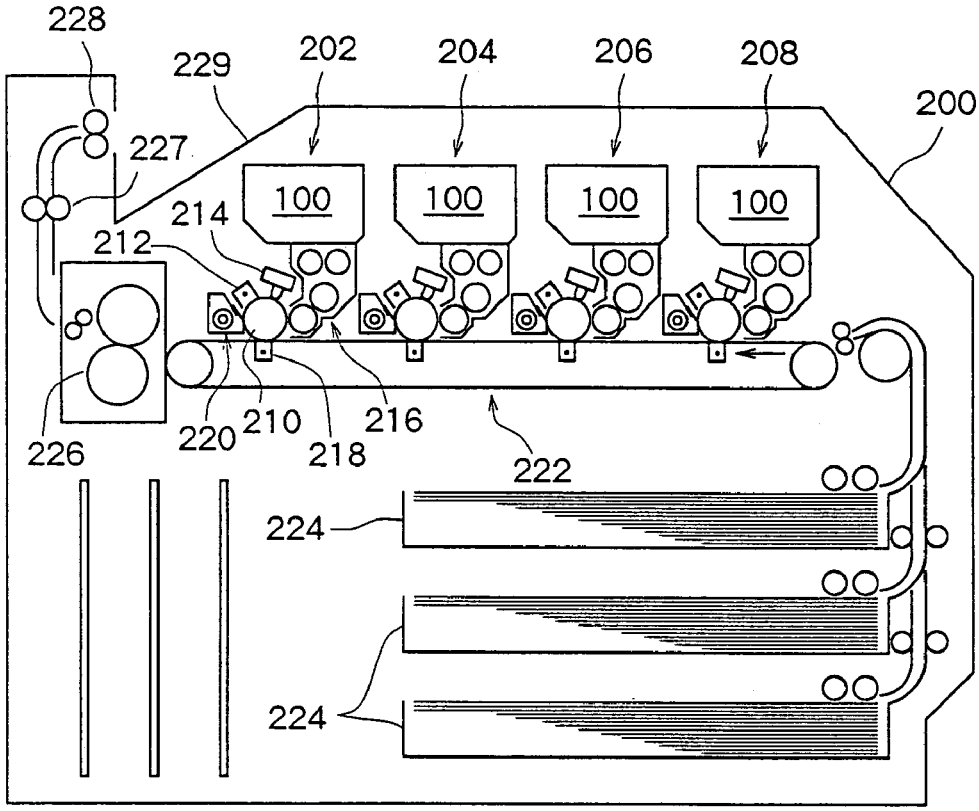
FIG. 1 is a sectional view schematically illustrating the constitution of a tandem-type image-forming machine equipped with a developing device on which are mounted toner supplying containers constituted according to the present invention.

FIG. 1 is a sectional view schematically illustrating the constitution of a tandem-type color image-forming machine equipped with a developing device on which are mounted toner supplying containers constituted according to the present invention. The illustrated tandem-type color image-forming machine is provided with an image-forming machine body 200 of nearly a rectangular parallelopiped shape. In the image-forming machine body 200, there are arranged a process unit 202 for black, a process unit 204 for cyan, a process unit 206 for magenta, and a process unit 208 for yellow in this order from the left toward the right in FIG. 1. The process units 202, 204, 206 and 208 are each equipped with image-forming elements such as a photosensitive material drum 210, a charging unit 212, an LED head 214 that is part of a exposure means, a developing device 216, a transfer device 218 and a cleaning device 220. For simplifying illustration in FIG. 1, reference numerals for the image-forming elements are attached to those of the process unit 202 for black only.

The developing devices 216 of the process units 202, 204, 206 and 208 are respectively equipped with toner supplying containers 100 for supplying toners of the corresponding colors. On the under side of the process units 202, 204, 206 and 208, there is arranged a conveyer belt unit 222 to hold the recording paper and to convey it in the direction of an arrow. A fixing device 226, carrier rollers 227 and discharge rollers 228 are arranged on the downstream side of the conveyer belt unit 222 in the direction in which the recording paper is conveyed. A paper discharge tray 229 is disposed at an upper end of the image-forming machine body 200 on the outer side of the discharge rollers 228. The conveyer belt unit 222 conveys the recording papers delivered from the paper-feed cassettes 224 arranged on the lower side thereof to pass through between the photosensitive material drums 210 and the transfer devices 218 in the process units 208, 206, 204 and 202. In the process units 208, 206, 204 and 202, electrostatic latent images are formed on the surfaces of the photosensitive material drums 210 uniformly charged by the charger units 212 are exposed to light from the LED heads 214. The electrostatic latent images are developed by the developing devices 216 to form toner images. By the transfer devices 218, the toner images are transferred in a overlapping way on the recording paper conveyed by the conveyer belt unit 222 successively starting with the toner image formed by the process unit 208 on the upstream side. The color toner image transferred onto the recording paper is fixed on the recording paper as it passes through the fixing device 226, and the recording paper onto which the color toner image has been fixed is discharged onto the paper discharge tray 229 by the conveyer rollers 227 and the discharge rollers 228. The toner remaining on the surface of the photosensitive material drum 210 without being transferred is wiped off by the cleaning device 220. The above tandem-type color image-forming machine is constituted in a known manner without creating the feature of the present invention and is not, hence, described any further.

Figure 2:
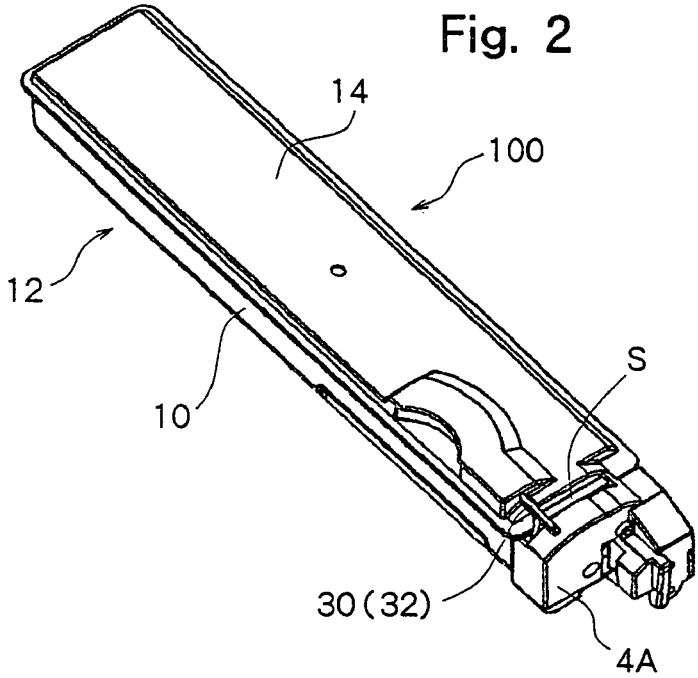
FIG. 2 is a perspective view of the toner supplying container constituted according to the present invention.
Figure 3:
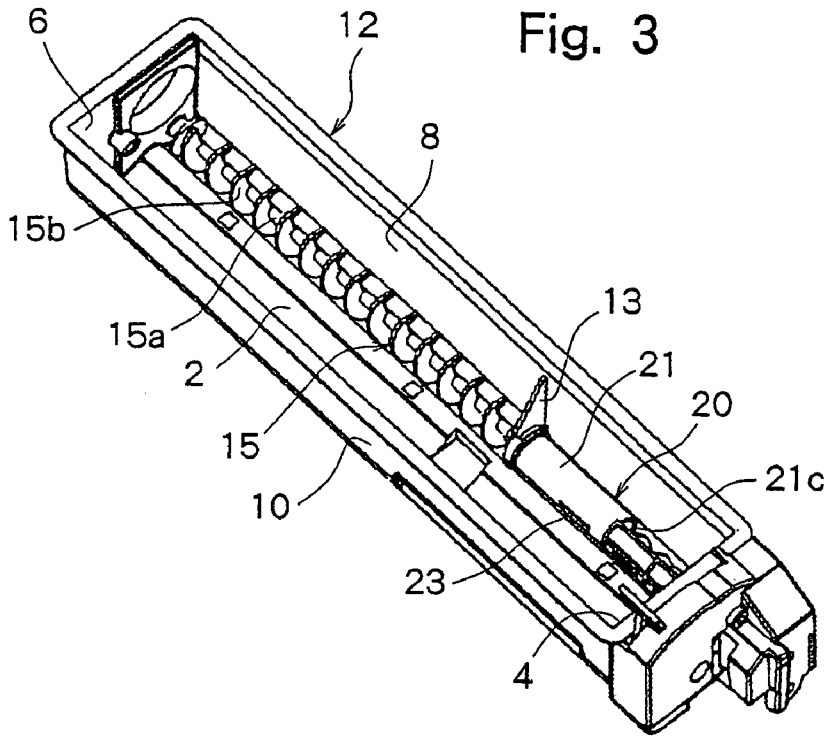
FIG. 3 is a perspective view illustrating a state where a closure member is removed from the toner supplying container illustrated in FIG. 2.
Figure 4:
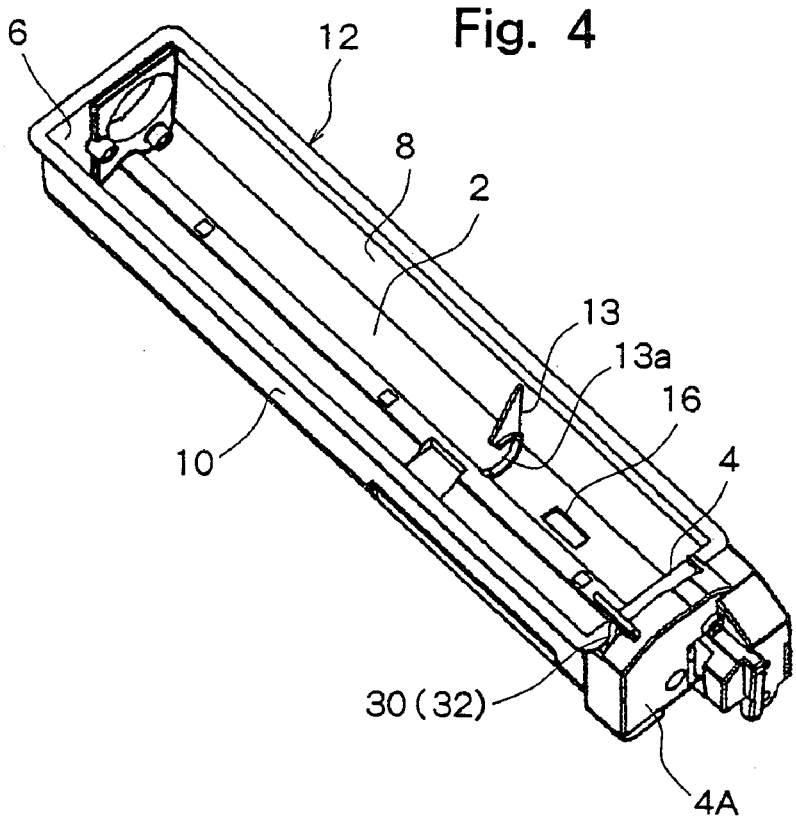
FIG. 4 is a perspective view illustrating a container body in the toner supplying container illustrated in FIG. 2.

Next, the toner supplying container 100 constituted according to the present invention will be described in detail. Referring to FIGS. 2 to 4, the toner supplying container 100 is provided with a container body 12 which comprises a vertically elongated bottom wall 2 having a predetermined width, end walls 4 and 6 extending upward from both ends in the lengthwise direction of the bottom wall 2, and side walls 8 and 10 extending upward from both side edges of the bottom wall 2. The opening at an upper end of the container body 12 integrally formed by using a suitable synthetic resin, i.e., a styrene resin in this embodiment, is closed by a closure member 14. The closure member 14, too, is integrally formed by using a suitable synthetic resin, i.e., a styrene resin in this embodiment. The closure member 14 is heat-melt-adhered to the container body 12 by a suitable method such as ultrasonic melt-adhesion to close the opening at the upper end. The region of the bottom wall 2 neighboring the one side wall 8 is formed in a predetermined arcuate form in lateral cross section from one end toward the other end in the lengthwise direction. A toner discharge opening 16 of a rectangular shape is formed in the arcuate region at a position closer to the one end wall 4.

Referring to FIGS. 3 to 7, a shutter member 20 is disposed in the container body 12. The shutter member 20 is disposed in the container body 12 so as to be turned between a closing position where the toner discharge opening 16 is closed and an opening position where the toner discharge opening 16 is opened. If described more concretely, the shutter member 20 has a substantially cylindrical shutter body 21 that is disposed in the container body 12 so as to be turned and extends from one end wall 4 along part of the arcuate region of the bottom wall 2 in the lengthwise direction, and a shutter drive member 22 that is coupled to the shutter body 21 so as to be rotated together with the shutter body 21 and is supported by the one end wall 4 so as to be rotated.

The container body 12 has a nearly plate-like support flange 13 extending from one side wall 8 so as to traverse the arcuate portion of the bottom wall 2. The support flange 13 has a support hole 13*a* formed in a manner that part of the region thereof in the circumferential direction is cut away. The shutter body 21 has annular large-diameter flange portions 21*a* and 21*b* at both ends thereof in the axial direction. The annular large-diameter flange portions 21*a* and 21*b* are placed on the arcuate regions of the bottom wall 2 so as to be turned, and one end thereof in the axial direction is fitted into the support hole 13*a* of the support flange 13, so that the shutter body 21 is arranged in the container body 12 so as to be turned. A toner receiving opening 21*c* is formed in nearly the half region of the shutter body 21 in the axial direction by cutting away nearly half portion thereof in the circumferential direction, and a rectangular toner passage opening 23 is formed in the cylindrical portion thereof where the toner receiving opening 21*c* has not been formed. The toner passage opening 23 is formed in nearly the same shape and size as those of the toner discharge opening 16. Engaging protrusions (not shown) are formed in a plural number on the inner peripheral surface of a cylindrical shape at the other end of the shutter body 21 in the axial direction at proper intervals in the circumferential direction. The thus constituted shutter body 21 is integrally molded by using a suitable synthetic resin, i.e., a styrene resin in this embodiment.

A rotary spiral vane member 15 is supported in the container body 12 so as to be rotated to stir and convey the toner contained therein toward the toner discharge opening 16. The rotary spiral vane member 15 has a center shaft 15*a* and a spiral vane 15*b* formed on the outer peripheral surface of the center shaft 15*a*. An annular flange portion 15*c* of a diameter larger than that of the spiral vane 15*b* is formed at one end of the center shaft 15*a* in the axial direction. A region of the rotary spiral vane member 15 on one end side is inserted in the shutter body 21, the annular flange portion 15*c* is supported in the shutter body 21 so as to be rotated, and the other end of the center shaft 15*a* is supported by the other end wall 6 so as to be rotated. Thus, the rotary spiral vane member 15 is disposed in the container body 12 so as to be rotated. The thus constituted rotary spiral vane member 15 is integrally molded by using a suitable synthetic resin, i.e., a styrene resin in this embodiment.

Figure 9:
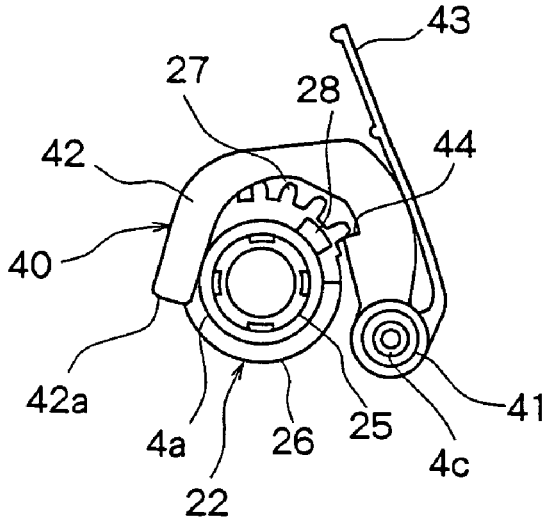
FIG. 9 is a partial view of a shutter drive member, locking member and support shaft shown in FIG. 8 as viewed from the side of the container body while removing the end wall.

A support cylindrical portion 4*a* is formed on one end wall 4 of the container body 12 so as to protrude outward beyond the end wall 4. The support cylindrical portion 4*a* is disposed on an axis substantially common to those of the shutter body 21 and the rotary spiral vane member 15. The support hole formed by the support cylindrical portion 4*a* penetrates through the one end wall 4. The shutter drive member 22 integrally molded by using a suitable synthetic resin, i.e., an ABS in this embodiment has a base portion 24 in which the through hole is formed, a relatively long small-diameter. cylindrical portion 25 and a relatively short large-diameter cylindrical portion 26. The cylindrical portions 25 and 26 are extending outward in the axial direction from one end of the base portion 24 in the axial direction. The through hole in the base portion 24, the small-diameter cylindrical portion 25 and the large-diameter cylindrical portion 26 are arranged on a common axis. To-be-engaged recessed portions (see FIGS. 7 and 9) are formed in a plural number in the outer peripheral surface at the end of the small-diameter cylindrical portion 25 at proper intervals in the circumferential direction. The whole semicircular region at an end of the large-diameter cylindrical portion 26 is cut away from the end toward the base portion 24 at a predetermined length in the axial direction. A driven gear 27 is formed on the outer peripheral surface of the other semicircular region at the end of the large-diameter cylindrical portion 26, the driven gear 27 extending in an arcuate shape along the outer peripheral surface. A to-be-engaged protrusion 28 is formed on the end surface of the other semicircular region which is at the end of the large-diameter cylindrical portion 26 in the axial direction, the to-be-engaged protrusion 28 extending in the axial direction (axial direction heading toward the one end wall 4) from the end surface. The to-be-engaged protrusion 28 has the same thickness as the large-diameter cylindrical portion 26 in the radial direction, and is so formed as to extend in the circumferential direction at a predetermined width only from one end to the other end of the driven gear 27 in the circumferential direction. Both end surfaces of the to-be-engaged protrusion 28 in the circumferential direction are so formed as to extend in the radial direction as viewed in the axial direction.

The shutter drive member 22 formed as described above has the small-diameter cylindrical portion 25 that is fitted into the through hole in the support cylindrical portion 4*a* formed in the one end wall 4 so as to be turned and has the large-diameter cylindrical portion 26 that is fitted along its inner peripheral surface onto the outer peripheral surface of the support cylindrical portion 4*a* so as to be turned. The to-be-engaged recessed portions formed in the outer peripheral surface at the end of the small-diameter cylindrical portion 25 of the shutter drive member 22 are brought into engagement with the engaging protrusions formed on the inner peripheral surface at the other end of the shutter body 21 in the axial direction. Thereby, the shutter drive member 22 is detachably coupled to the shutter body 21 so will not to be rotated relative to the shutter body 21. The shutter member 20 is thus constituted.

The container body 12 has a lever member 30 that is turnably supported by the container body 12 and is drivably coupled to the shutter member 20 so as to be turned between a closing position where the shutter member 20 is brought to the closing position and an opening position where the shutter member 20 is brought to the opening position. If described more concretely, in the one end wall 4, a cylindrical support shaft 4*b* is formed to extend outward. The axis of the support shaft 4*b* is arranged on a tilted upper side with respect to the axis of the support cylindrical portion 4*a* in the transverse direction maintaining a distance thereto (tilted upper side on the left in FIG. 5). The lever member 30 has a plate-like lever body 31 having an arcuate peripheral surface, an operation lever 32 extending outward in the radial direction from the lever body 31, and a cylindrical base portion 33 that is formed in the central portion of the lever body 31 and is supported by the one end wall 4 so as to be turned. The arcuate peripheral surface of the lever body 31 forms part of nearly a semicircular peripheral surface having an axis common to that of the cylindrical base portion 33, and a drive gear 34 is formed on the arcuate peripheral surface along the peripheral surface. A pushing protrusion 35 extending outward in the radial direction is formed on the cylindrical base portion 33. The pushing protrusion 35 has a predetermined width in the circumferential direction and a length in the axial direction, and has an outer end in the radial direction, that is of a semicircular shape as viewed in the axial direction. Since the cylindrical base portion 33 is supported by the outer peripheral surface of the support shaft 4*b* so as to be turned, the lever member 30 is supported by the one end wall 4 of the container body 12 so as to be turned. The thus constituted lever member 30 is integrally molded by using a suitable synthetic resin, i.e., an ABS in this embodiment.

The container body 12 is equipped with a locking member 40 supported by the container body 12 so as to be turned between a locking position where the shutter member 20 (i.e., shutter body 21 and shutter drive member 22) is locked so that it is not caused to turn from the closing position to the opening position and a lock-releasing position where the shutter member 20 is permitted to be turned from the closing position to the opening position and further to be turned in the reverse direction. If described more specifically, the one end wall 4 has a support shaft 4*c* formed to extend outward. The axis of the support shaft 4*c* is arranged on a tilted lower side with respect to the axis of the support cylindrical portion 4*a* in the transverse direction maintaining a distance thereto (tilted lower side on the left in FIG. 5). The support shaft 4*c* is disposed at a position midway between the support cylindrical portion 4*a* and the support shaft 4*b* in the transverse direction (right-and-left direction in FIG. 5). The support cylindrical portion 4*a*, support shaft 4*b* and support shaft 4*c* have axes in parallel with one another.

The locking member 40 has an base end 41 of a cylindrical shape, a plate-like locking body 42 of nearly a hooked shape, and a belt-like elastic portion 43. By the base end 41 being turnably supported by the support shaft 4*c*, the locking member 40 is supported by the one end wall 4 so as to be turned. In a state where the locking member 40 is supported by the one end wall 4 so as to be rotated, the locking body 42 extends outward in the radial direction from the base end 41, and permits the position in the axial direction where the to-be-engaged protrusion 28 of the shutter drive member 22 exists [i.e., the position of the driven gear 27 formed on the large-diameter cylindrical portion 26, close to the outer side in the axial direction (on the side of the one end wall 4)] to be substantially extended in a direction in which the shutter drive member 22 turns. The elastic portion 43 is so constituted that a position on the outer side in the radial direction with part of the region of the locking body 42 being interposed relative to the axis of the shutter drive member 22 extends outward in the radial direction of the base end 41 from the outer peripheral surface of the base end 41, and has the shape of nearly a bow as viewing the base end 41 from the axial direction. The elastic portion 43 is formed in the shape of a belt having a relatively narrow constant width and a relatively small thickness. The direction of width of the elastic portion 43 is positioned to be in agreement with a direction (i.e., direction perpendicular to the surface of the paper in FIG. 7) which is in parallel with the axes of the cylindrical base end 41 and of the support shaft 4*c*. The locking body 42 has a width and a thickness (thickness of the base end 41 in the axial direction), which do not substantially undergo elastic deformation. The direction of width of the locking body 42 is positioned to be substantially in agreement with the radial direction of the shutter drive member 22. An engaging step 44 is formed in the inner surface in the radial direction of the locking body 42 and extends substantially in the radial direction of the shutter drive member 22. That is, the inner surface in the radial direction of the locking body 42 is so constituted that it extends nearly in the circumferential direction around the axis of the shutter drive member 22 from the base end 41, extends outward in the radial direction at the engaging step 44 and extends again nearly in the circumferential direction. The thus constituted locking member 40 is integrally molded by using a suitable synthetic resin, i.e., an ABS in this embodiment.

The shutter drive member 22, lever member 30 and locking member 40 are attached to the one end wall 4 in order of, first, fitting the locking member 40 to the support shaft 4*c* so as to be supported thereby, then, fitting the shutter drive member 22 to the support cylindrical portion 4*a* so as to be supported thereby and, finally, fitting the lever member 30 to the support shaft 4*b* so as to be supported thereby. A region of the locking member 40 excluding the base end of the elastic portion 43 and a partial region of the outer edge of the locking body 42 in the radial direction, are positioned between the lever body 31 of the lever member 30 and the one end wall 4. Referring to FIG. 6, a shaft 51 forming a driven gear 50 at one end thereof is fitted into the through hole of the shutter drive member 22 so as to rotate. An end of the shaft 51 is detachably coupled to one end of the center shaft 15*a* of the rotary spiral vane member 15 arranged in the container body 12 so as to inhibit to rotate relative thereto. The driven gear 50 is positioned at an end in the axial direction of the base portion 24 of the shutter drive member 22. The driven gear 50 and the shaft 51 are integrally molded by using a suitable synthetic resin, i.e., a styrene resin in this embodiment. After the above-mentioned members are mounted on the container body 12, a cover member 4A is detachably mounted on the outer side of the one end wall 4 of the container body 12 as shown in FIG. 2. A slit S is formed between the outer upper edge of the one end wall 4 and the upper edge of the cover member 4A facing thereto. The slit S is extending in the direction of width (right-and-left direction in FIG. 5) of the container body 12, and the operation lever 32 of the lever member 30 protrudes upward through the slit S. This constitution facilitates the operation for opening and closing the shutter member 20 by using the lever member 30. In a state where the cover member 4A is mounted on the outer side of the one end wall 4, the above-mentioned members are covered by the cover member 4A,but a partial region in the circumferential direction of the driven gear 50 and the end of the locking body 42 of the locking member 40 are exposed on the lower side.

Figure 5:
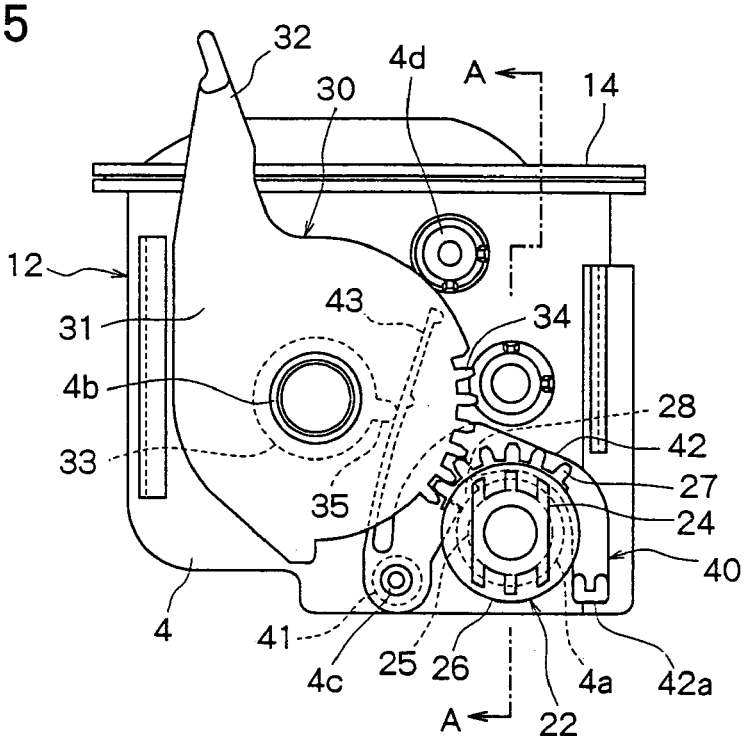
FIG. 5 is a side view of the toner supplying container illustrated in FIG. 2 as viewed from the side of one end wall in a state where the cover member is removed from the one end wall.
Figure 6:
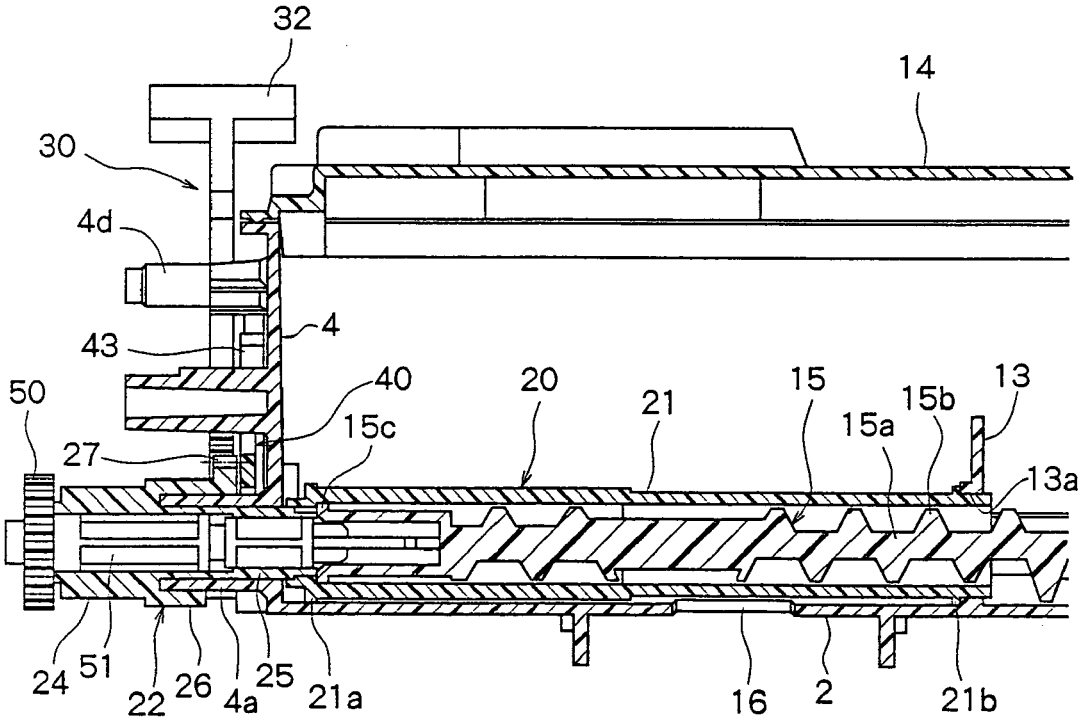
FIG. 6 is a sectional view along the arrow A—A of FIG. 5 and omitting some of the portions.
Figure 7:
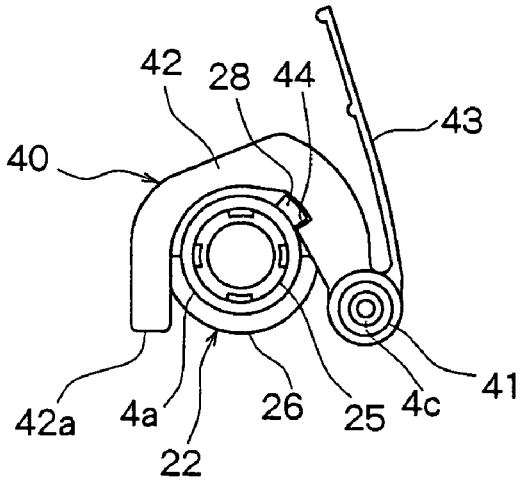
FIG. 7 is a partial view of a shutter drive member, locking member and support shaft shown in FIG. 5 as viewed from the side of the container body, excepting for the end wall.
Figure 8:
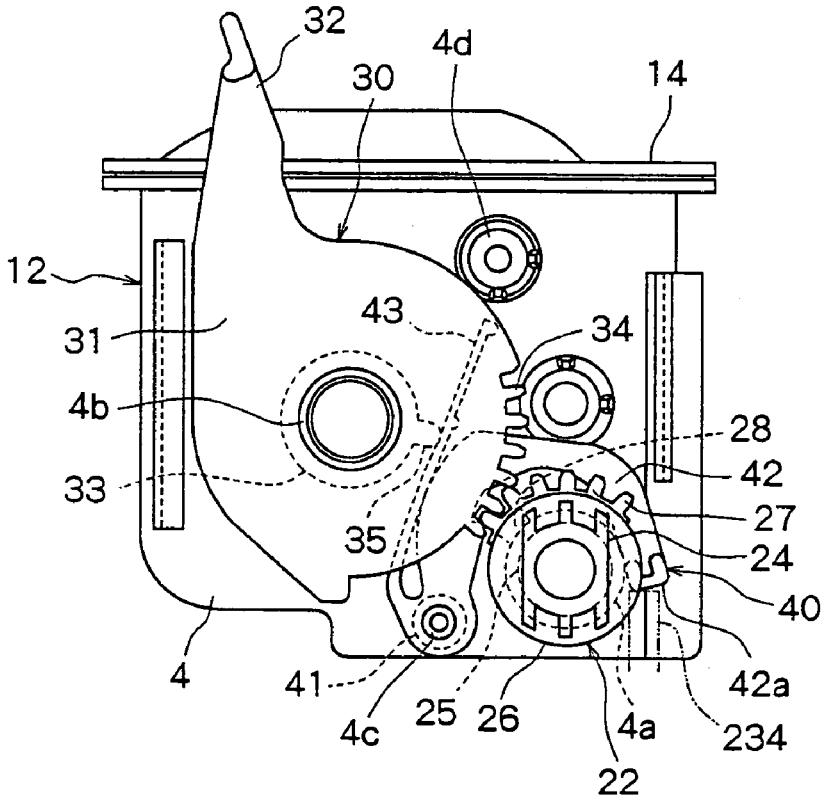
FIG. 8 is a side view illustrating another operating state of the toner supplying container shown in FIG. 5.

Referring to FIGS. 5 and 7, the lever member 30 at its closing position causes the elastic portion 43 of the locking member 40 to be elastically deformed and urges the locking member 40 toward the locking position. If described more specifically, in a state where the lever member 30 is positioned at the closing position, the drive gear 34 of the lever member 30 is in mesh with the driven gear 27 of the shutter drive member 22, and the end of the pushing protrusion 35 of the lever member 30 is so positioned as to push the one surface (one surface positioned on the outer side in the radial direction relative to the axis of the shutter drive member 22) of the elastic portion 43 of the locking member 40 to elastically deform it. Then, the locking body 42 of the locking member 40 is so urged that the region thereof including at least the engaging step 44 in the inner surface in the radial direction is turned on the axis of the base end 41 in a direction to approach the axis of the shutter drive member 22 from the outer side in the radial direction (the locking body 42 is imparted with such rotational torque). The engaging step 44 of the locking body 42 is brought into engagement with an end surface in the circumferential direction of the to-be-engaged protrusion 28 of the shutter drive member 22, i.e., brought into engagement with the end surface of the shutter drive member 22 in a turning direction in which the shutter member 20 rotates from the closing position toward the opening position (counterclockwise direction in FIG. 5 or clockwise direction in FIG. 7).

When the locking member 40 is thus brought to the locking position, the shutter member 20 is prevented from turning to the opening position from the closing position, i.e., the to-be-engaged protrusion 28 of the shutter drive member 22 is reliably blocked (locked) by the engaging step 44 in the locking body 42. Therefore, the lever member 30 of which the drive gear 34 is in mesh with the driven gear 27 of the shutter drive member 22, is also prevented from turning to the opening position, and the shutter member 20 remains at the locked position. As a result, the toner that is contained can be reliably prevented from leaking before the toner supplying container 100 is mounted on the developing device or on the image-forming machine body, which is the mounting member, or after it is removed therefrom, or at the time of attaching or detaching the toner supplying container 100. In a state where the lever member 30 is at the closing position, the cylindrical outer peripheral surface of the shutter body 21 is positioned facing the toner discharge opening 16, and the toner passage opening 23 is positioned being completely deviated from the toner discharge opening 16 in the circumferential direction. Therefore, the toner that is contained does not leak from the toner passage opening 23. It needs not be pointed out that if a suitable sealing member is arranged at the peripheral edge of the toner discharge opening 16, leakage of the toner is very reliably prevented.

In a state where the lever member 30 is at the closing position, the shutter member 20 is at the closing position and the locking member 40 is at the locking position, as described above, a front end surface 4*a* of the locking body 42 of the locking member is directed in the downward direction of the container body 12. In this embodiment, the front end surface 42*a* of the locking body 42 is directed downward nearly vertically in a state where the bottom wall 2 of the toner supplying container 100 is directed downward nearly vertically and the closure member 14 is directed upward nearly vertically. In the illustrated embodiment, the end of the locking body 42 is formed in nearly an L-shape so as to extend from the one surface thereof (from the one surface on the side opposite to the side facing the one end wall 4) at right angles in a direction in which it separates away from the end wall 4.

When the container body 12 (i.e., toner supplying container 100) is mounted on the developing device or on the image-forming machine body, which is the mounting member, the locking member 40 is displaced from the locking position to the lock-releasing position against the elastic force of the elastic portion 43, and permits the lever member 30 to be turned from the closing position to the opening position. When the container body 12 (i.e., toner supplying container 100) is removed from the mounting member in a state where the lever member 30 has been turned from the opening position to the closing position, then, the locking member 40 returns to the locking position due to the elastic force of the elastic portion 43.

Figure 11:
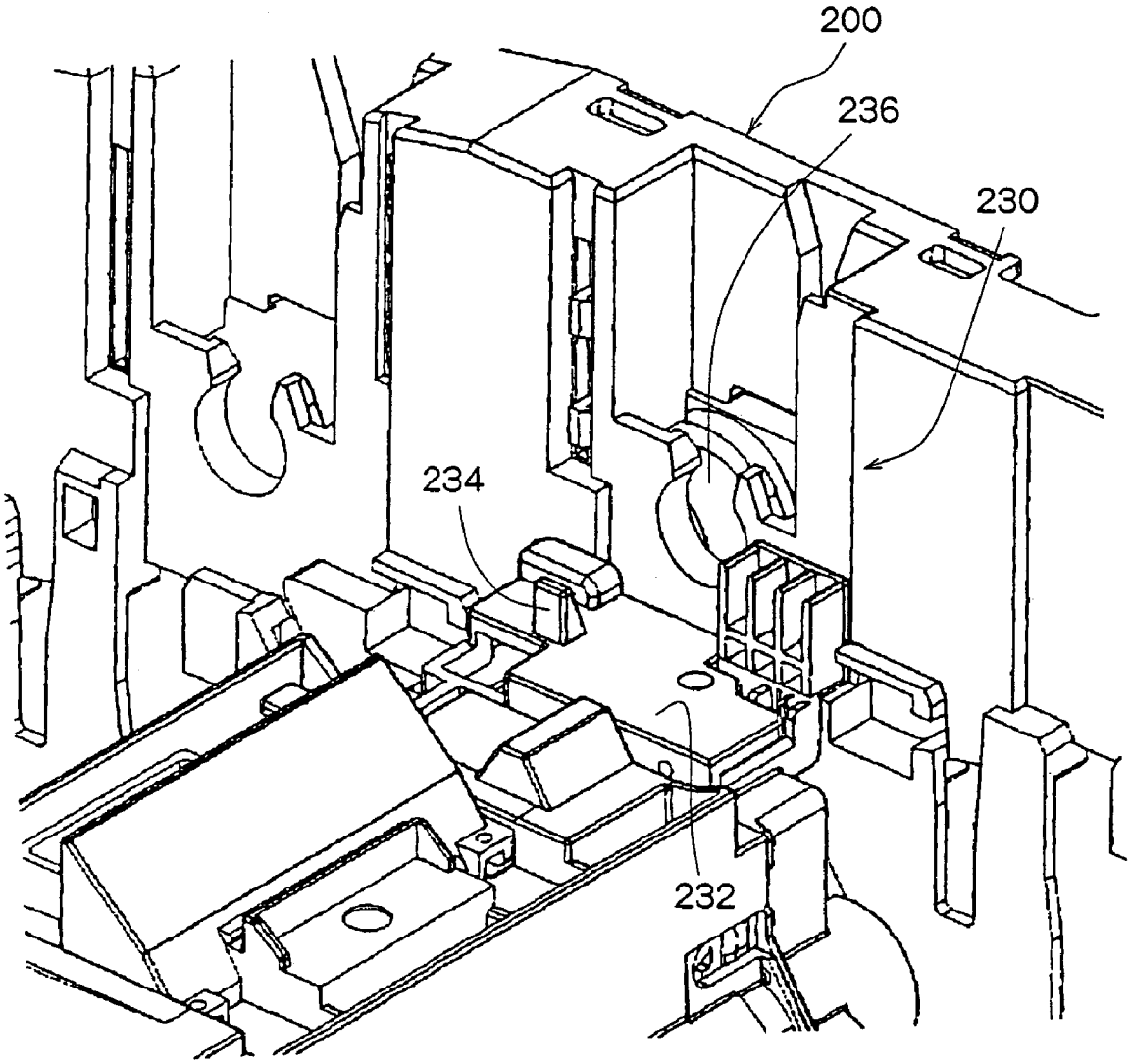
FIG. 11 is a perspective view illustrating part of a mounting portion in the image-forming machine body on which is mounted the toner supplying container shown in FIG. 2.
Figure 12:
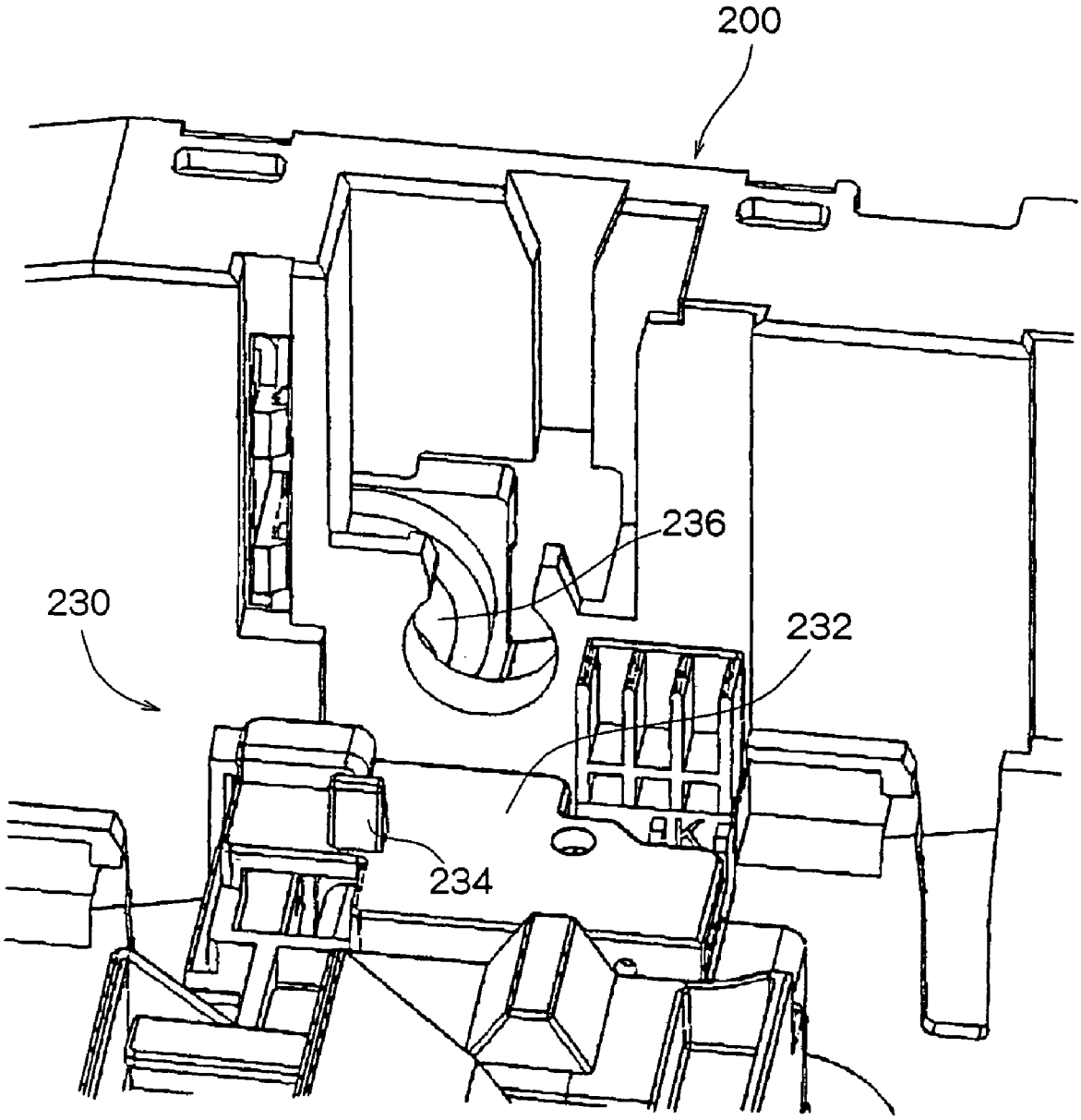
FIG. 12 is a perspective view illustrating part of the mounting portion shown in FIG. 11 as viewed from another angle.

The invention will now be described more specifically with reference to FIGS. 8 to 12. As illustrated in FIGS. 11 and 12, the image-forming machine body 200 is provided with a mounting portion 230 for mounting the toner supplying container 100, and a push-up protrusion 234 is formed upright on an upper surface 232 that constitutes part of the mounting portion 230. In FIGS. 11 and 12, reference numeral 236 denotes a drive gear arranged in the image-forming machine body 200. The drive gear 236 is drivably coupled to an electric motor via a transmission mechanism (both of which are not shown). When a drop in the ratio of the toner in the developing agent in the developing device 216 is detected, the electric motor is driven for only a period of time necessary for supplying a required amount of toner from the toner supplying container 100 into the developing device 216. When the toner supplying container 100 is mounted on the mounting portion 230 by being moved from the upper side toward the lower side, the driven gear 50 in the toner supplying container 100 is brought into mesh with the drive gear 236 to permit the rotary spiral vane member 15 in the container body 12 to be rotationally driven. At the same time, the toner supplying container 100 is further lowered by a predetermined distance after the front end surface 42*a* of the locking body 42 of the locking member 40 is brought into contact with the push-up protrusion 234. Therefore, the front end surface 42*a* is pushed up by the predetermined distance. The locking body 42 of the locking member 40 is turned on the axis of the base end 41 (turned counterclockwise in FIG. 8 or clockwise in FIG. 9) in a direction in which the region including at least the engaging step 44 in the inner surface in the radial direction separates away outward in the radial direction from the axis of the shutter drive member 22 against the elastic force of the elastic portion 43. As a result, the engaging step 44 is displaced outward in the radial direction from the locking position (position illustrated in FIGS. 5 and 7) where the engaging step 44 comes into engagement with the upper end surface in the circumferential direction of the to-be-engaged protrusion 28 of the shutter drive member 22 toward the rock-resetting position (position illustrated in FIGS. 8 and 9) where the engagement is released from the end surface.

Figure 10:
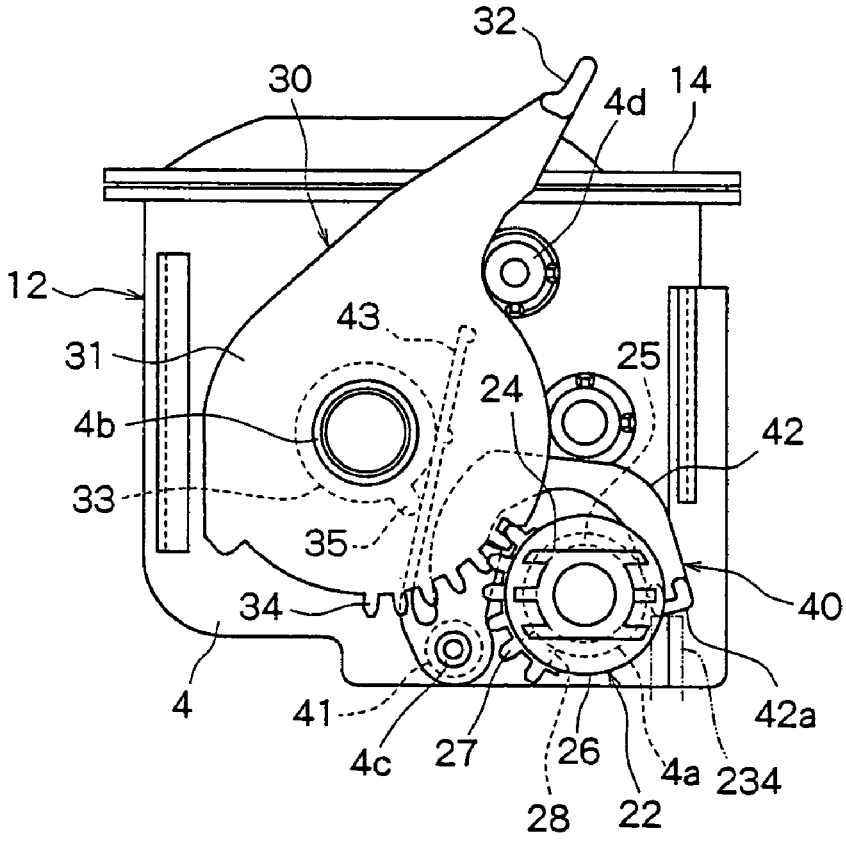
FIG. 10 is a side view illustrating a further another operating state of the toner supplying container shown in FIG. 8.

The shutter drive member 22 that is liberated from the locked state is now free to rotate, and the lever member 30 is allowed to be turned from the closing position (position illustrated in FIG. 5) to the opening position (position illustrated in FIG. 10). Referring to FIG. 10 together with FIGS. 8 and 9, if the lever member 30 is turned from the closing position to the opening position, the drive gear 34 of the lever member 30 is turned clockwise in FIG. 8 from the position shown in FIG. 8, and the driven gear 27 of the shutter drive member 22 that is in mesh with the drive gear 34 is turned counterclockwise in FIG. 8. The shutter drive member 22 is turned in a direction in which the shutter member 20 moves from the closing position to the opening position and hence, the shutter member 20 is turned from the closing position to the opening position. In a state where the lever member 30 is at the opening position, the toner passage opening 23 of the shutter body 21 is positioned in match with the toner discharge opening 16, and the toner that is contained is supplied from the toner discharge opening 16 to the outer side, i.e., into the developing device (not shown) in this embodiment, through the toner passage opening 23. A stopper pin 4*d* is formed on the one end wall 4 in a manner to protrude outward, and when the lever member 30 is turned from the closing position to the opening position, the side surface of the lever member 30 in a direction in which it turns, is brought into contact with the stopper pin 4*d* to block any further turn.

When the lever member 30 is turned from the closing position to the opening position in a state where the toner supplying container 100 is mounted on the mounting portion 230 of the image-forming machine body 200 as described above, a pushing force exerted by the lever member 30 on the elastic portion 43 of the locking member 40 is decreased. As will be easily comprehended from the comparison of FIG. 10 with FIG. 8, when the lever member 30 is turned from the closing position to the opening position, the pushing protrusion 35 of the lever member 30 is turned up to a position where it is no longer brought into contact with one surface of the elastic portion 43 of the locking member 40. Due to its elastic force, therefore, the elastic portion 43 is displaced in a direction in which it returns to the shape of when it was molded. Finally, therefore, the elastic portion 43 is maintained in a state where the one surface thereof is brought into pressed contact with the outer peripheral surface of the cylindrical base portion 33 of the lever member 30. The amount of elastic deformation of the elastic portion 43 in this state is very smaller than the amount of elastic deformation at the time when the pushing protrusion 35 of the lever member 30 pushes the one surface of the elastic portion 43 of the locking member 40 (i.e., a pushing force exerted by the lever member 30 on the elastic portion 43 of the locking member 40 is greatly decreased). Therefore, even if this state continues until the toner in the container body 12 is depleted, the elastic portion 43 made of a synthetic resin is substantially avoided from being permanently distorted. There can be also easily contrived other embodiments in which the pushing force exerted by the lever member 30 on the elastic portion 43 of the locking member 40 is almost eliminated or is completely eliminated when the lever member 30 is turned from the closing position to the opening position in a state where the toner supplying container 100 is mounted on the mounting portion 230 of the image-forming machine body 200.

As a result, even when the toner supplying container 100 is removed from the mounting portion 230 of the image-forming machine body 200 after the toner discharge opening 16 is closed by turning the lever member 30 from the opening position to the closing position in a state where the toner supplying container 100 is mounted on the mounting portion 230 of the image-forming machine body 200, the elastic force of the elastic portion 43 is large enough for returning the locking body 42 of the locking member 40 to the locking position from the lock-releasing position. After the toner supplying container 100 is removed from the mounting portion 230 of the image-forming machine body 200, therefore, the toner discharge opening 16 is reliably prevented from being opened even if unexpected external force happens to be exerted on the lever member 30.

The above-mentioned toner supplying container 100 of the present invention uses no metallic spring member that was used in the conventional toner supplying containers, and makes it possible to decrease the number of parts and to decrease the cost. Besides, the whole container is constituted by using synthetic resin members only without at all using metallic parts, and requires no sorting operation when it is to be disposed of. According to the toner supplying container 100 of the present invention, further, the locking member 40 is not liberated from the locked state unless the toner supplying container 100 is correctly mounted on the proper position of the mounting portion 230. Based only on the operation of the lever member 30, therefore, there is obtained the effect of confirming whether the toner supplying container 100 is mounted on the normal position of the mounting portion 230.

In the above-mentioned toner supplying container.100 of the present invention, further, the front end surface 42*a* of the locking body 40 of the locking member 40 is directed in the downward direction of the container body 12, and the container body 12 is mounted on the image-forming machine body 200 which is the mounting member from the upper side. At this time, the front end surface 42*a* is pushed up as it comes in contact with the push-up protrusion 234 disposed in the image-forming machine body 200, whereby the locking body 42 of the locking member 40 is turned on the axis of the base end 41 in a direction in which the inner surface thereof in the radial direction separates away outward in the radial direction from the shutter drive member 22 against the elastic force of the elastic portion 43, and the engaging step 44 is displaced from the locking position where it engages with the one end surface in the circumferential direction of the to-be-engaged protrusion 28 of the shutter drive member 22, to the lock-releasing position where the engagement with the end surface is released. As will be easily comprehended from the foregoing description, the front end surface 42*a* of the locking body 42 of the locking member 40 is located at a position which is close to the lower surface of the container body 12 and hence, its presence cannot be relatively easily noticed. Therefore, the front end surface 42*a* is very little likely to be mistakenly touched by the user. Accordingly, there can be prevented the leakage of the toner, which may occur when the front end surface 42*a* of the locking body 40 is inadvertently pushed up by hand to release the locking.

In the toner supplying container disclosed in Japanese Unexamined Patent Publication (Kokai) No. 5-249820 described earlier, the rotary drive portion of the toner conveyer screw is locked by a locking means before the toner supplying container is mounted on the image-forming machine body which is the mounting member or after it is removed therefrom. However, even after the toner conveyer screw is locked, there is probability that the shutter member is opened due to some cause unless the shutter member is locked, and the leakage of toner cannot be prevented. On the contrary, in the toner supplying container 100 of the present invention, the lever member 30 elastically deforms the elastic portion 43 of the locking member 40 to urge the locking member 40 to the locking position in a state where the lever member 30 is at the closing position. As a result, the shutter member 20 is reliably locked and hence, the probability of toner leakage that could happen in the above-mentioned conventional toner supplying containers can be reliably avoided.

I claim:

1. A toner supplying container comprising a container body having a toner discharge opening, a shutter member disposed in the container body so as to be turned between a closing position for closing the toner discharge opening and an opening position for opening the toner discharge opening, a lever member that is supported by the container body and is drivably coupled to the shutter member so as to be turned between a closing position where the shutter member is brought to the closing position and an opening position where the shutter member is brought to the opening position, and a locking member supported by the container body so as to be turned between a locking position where the shutter member is locked to be inhibited from turning from the closing position to the opening position and a lock-releasing position where the shutter member is permitted to be turned from the closing position to the opening position and to be turned in the reverse direction, the locking member being provided with an elastic portion integrally; wherein a mounting member for mounting the container body is provided with a push-up protrusion protruding from the mounting portion;

the locking member forms a locking body that extends outward in the radial direction from a base end supported by one end wall so as to be turned and permits a position where a to-be-engaged protrusion of the shutter drive member is existing in the axial direction to be substantially extended in the direction of turning of the shutter drive member; and an engaging step is formed in the inner surface in the radial direction of the locking body so as to extend in the radial direction of the shutter drive member; and in a state where the lever member is brought to the closing position, the lever member brings the to-be-engaged protrusion into engagement with the engaging step by elastically deforming the locking member and, when the container body is mounted on the mounting member, the push-up protrusion pushes the locking member and the locking member releases the engagement between the to-be-engaged protrusion and the engaging step overcoming the elastic force of the elastic portion to permit the lever member to be turned from the closing portion to the opening position and, when the container body is removed from the mounting member in a state where the lever member has been turned from the opening position to the closing position, the pushing member no longer pushes the locking body, and the locking member is returned back to the locking position while bringing the to-be-engaged protrusion into engagement with the engaging step due to the elastic force on the elastic member.

2. A toner supplying container comprising a container body having a toner discharge opening, a shutter member disposed in the container body so as to be turned between a closing position for closing the toner discharge opening and an opening position for opening the toner discharge opening, a lever member that is supported by the container body and is drivably coupled to the shutter member so as to be turned between a closing position where the shutter member is brought to the closing position and an opening position where the shutter member is brought to the opening position, and a locking member supported by the container body so as to be turned between a locking position where the shutter member is locked to be inhibited from turning from the closing position to the opening position and a lock-releasing position where the shutter member is permitted to be turned from the closing position to the opening position and to be turned in the reverse direction, the locking member being provided with an elastic portion integrally wherein the container body has a bottom wall having the toner discharge opening formed therein and both end walls, and the shutter member comprises a substantially cylindrical shutter body that is turnably disposed in the container body so as to extend from one end wall along a partial region of the bottom wall and a shutter drive member that is coupled to the shutter body so as to be turned together with the shutter body and is supported by one end wall so as to be turned;

the shutter body has a toner passage opening that matches with the toner discharge opening when the shutter member is brought to the opening position;

the shutter drive member has an arcuately extending driven gear and a to-be-engaged protrusion extending in the axial direction, which are formed integrally;

the lever member has a plate-like lever body having an arcuate peripheral surface, an operation lever extending outward from the lever body in the radial direction, and a cylindrical base portion that is formed on the central portion of the lever body and is supported by one end wall so as to be turned, a drive gear being formed on the arcuate peripheral surface of the lever body, and a pushing protrusion being formed on the cylindrical base portion so as to extend outward in the radial direction;

the locking member has a locking body that extends outward in the radial direction from a base end supported by one end wall so as to be turned and an engaging step being formed in the inner surface in the radial direction of the locking body so as to extend in the radial direction of the shutter drive member; and in a state where the lever member is brought to the closing position, the drive gear of the lever member is brought in mesh with a driven gear of the shutter drive member, and the pushing protrusion of the lever member pushes the elastic portion of the locking member so as to be elastically deformed, whereby the locking body of the locking member is urged to turn about the axis of the base end in a direction in which a region including at least the engaging step in the inner surface in the radial direction approaches the axis of the shutter drive member from the outer side in the radial direction, and the engaging step is engaged with an end surface of the to-be-engaged protrusion of the shutter drive member in the circumferential direction.

3. A toner supplying container according to claim 2, wherein the front end surface of the locking body of the locking member is directed in the downward direction of the container body, and when the container body is mounted on the mounting member from the upper side and is brought into contact with the push-up protrusion disposed in the mounting member thereby causing the front end surface to be pushed up, the locking body of the locking member is caused to turn on the axis of the base end in a direction in which the inner surface thereof in the radial direction separates outward in the radial direction away from the shutter drive member against the elastic force of the elastic portion, and the engaging step is displaced from the locking position where it is engaged with the end surface of the to-be-engaged protrusion of the shutter drive member in the circumferential direction thereof, to the lock-releasing position where it is disengaged from said end surface.

4. A toner supplying container according to claim 2, wherein the container body, shutter member, lever member and locking member are made of a synthetic resin in a unitary structure.

5. A toner supplying container according to claim 3, wherein the container body, shutter member, lever member and locking member are made of a synthetic resin in a unitary structure.

* * * * *